United States Patent [19]

Ryder

[11] Patent Number: 4,981,657

[45] Date of Patent: Jan. 1, 1991

[54] CONTACT LENS CASE WITH RAISED, PROTECTIVE RIBS

[75] Inventor: Francis E. Ryder, Arab, Ala.

[73] Assignee: Ryder International Corporation, Arab, Ala.

[21] Appl. No.: 242,967

[22] Filed: Sep. 9, 1988

[51] Int. Cl.[5] ..... A61L 2/18

[52] U.S. Cl. ..... 422/310; 206/5.1; 422/297; 422/300

[58] Field of Search ..... 422/297, 300, 310; 206/5.1

[56] References Cited

U.S. PATENT DOCUMENTS

| | | | |
|---|---|---|---|
| 3,661,248 | 5/1972 | Isen et al. | 206/5.1 X |
| 4,388,521 | 6/1988 | Thomas et al. | 422/300 X |
| 4,637,919 | 1/1987 | Ryder et al. | 422/300 |

*Primary Examiner*—Robert J. Warden
*Assistant Examiner*—Jill Johnston
*Attorney, Agent, or Firm*—R. A. Giangiorgi

[57] ABSTRACT

A lens support structure for holding a pair of contact lenses in a lens storage container includes a support frame having an integral stem portion and surface support means for the respective lenses. The support structure also includes a pair of lens holding members pivotably mounted on the support frame in which each holder member includes a basket-like cover portion which overlies the surface support means in the pivotably closed portion for enclosure of a respective lens therebetween. Each of the cover portions includes an interior surface oppositely facing the respective lens surface support means and the interior surface of the cover portion is provided with integrally molded, embossment means extending from the interior surface in order to ensure that the lens is engageable with or supported upon the extending embossment means and is spaced from the interior surface of the cover portion and thus spaced from any molding flash remaining at the mold parting surface or line which could otherwise scratch or tear or damage a soft lens in contact with the flash material particularly during manually removing the lens from the cover portion.

3 Claims, 1 Drawing Sheet

CONTACT LENS CASE WITH RAISED, PROTECTIVE RIBS

BACKGROUND OF THE INVENTION

This invention relates to improved storage and holding containers for small articles, particularly for protection of fragile or pliable articles such as "soft" contact lens.

The widely-used soft contact lenses require protective storage containers which may also be used for disinfecting treatment of the lenses. Numerous commercially successfully storage and disinfecting lens containers have been developed such as those described in U.S. Pat. No. 3,770,113, in which each lens of the pair is separately retained and enclosed by a concaved basket-like cover member. The basket-like cover member is typically pivoted to open or close the enclosure. The basket-like cover member is provided with through apertures which allow passage of the conditioning or disinfecting fluid in which the lenses are immersed.

The basket-like cover members and the associated apertures are typically fabricated by thermoplastic injection molding techniques using mold tooling in which two molds meet during the molding operation along the periphery of the molded cover member apertures. That is to say the parting line defined by the mold tooling will lie, at least partially, in the general location of said apertures. As such, excess molding resin or "flash" may remain at the parting line and thus on the basket edge structure which define the basket apertures. This "flash" results in a sharp, jagged or rough edge surface that can be a hazard to a contact lens during removal of a lens which may have adhered to the basket. In this regard, the lens is removed manually by the user placing a finger on the lens and sliding it out of the concaved basket-like cover member. During this sliding moment, the presence of an underlying sharp edge can causes damage to the lens.

The disadvantages of conventional lens cover baskets are eliminated by the basket structure in accordance with the subject invention.

SUMMARY OF THE INVENTION

In accordance with this invention, a lens support structure for holding a pair of contact lenses in a lens storage container includes a support frame having an integral stem portion and surface support means for the respective lenses. The support structure also includes a pair of lens holding members pivotably mounted on the support frame in which each holder member includes a basket-like cover portion which overlies the surface support means in the pivotably closed position for enclosure of a respective lens therebetween. Each of the cover portions includes an interior surface oppositely facing the respective lens surface support means and the interior surface of the cover portion is provided with integrally molded, embossment means extending from the interior surface in order to ensure that the lens is engageable with or supported upon the extending embossment means and is spaced from the interior surface of the cover portion and thus spaced from any molding flash remaining at the mold parting surface or line which could otherwise scratch or tear or damage a soft lens in contact with the flash material particularly during manually removing the lens from the cover portion.

In a preferred embodiment, the lens cover portion of the holder member has an annular arrangement of through apertures enabling passage of conditioning fluid in which the lenses are immersed within the container. Rib portions of the cover portion are formed between the apertures. Each of the ribs has an extending elongate projection directed toward the lens support means of the supporting frame in the closed position of the holder member. The annular arrangement of rib projections forms a reduced surface area for engagement with the contact lens which not only provides an embossment spaced from the mold parting line and any hazardous flash residue, but also promotes the more desirable adherence of the contact lens to the respective lens support means on the support frame due to the reduced area of adhesion surface of the rib projections. Adherence of the lens to the support surface eliminates the danger of inadvertent or unnoticed slipping of the lens from the opened cover member before manual removal. If a lens does adhere to the rib projections of the cover member, the reduced adhesion surface enables easier manual removal of the lens from the cover portion.

DETAILED DESCRIPTION OF THE ILLUSTRATED EMBODIMENT

Figure 1:
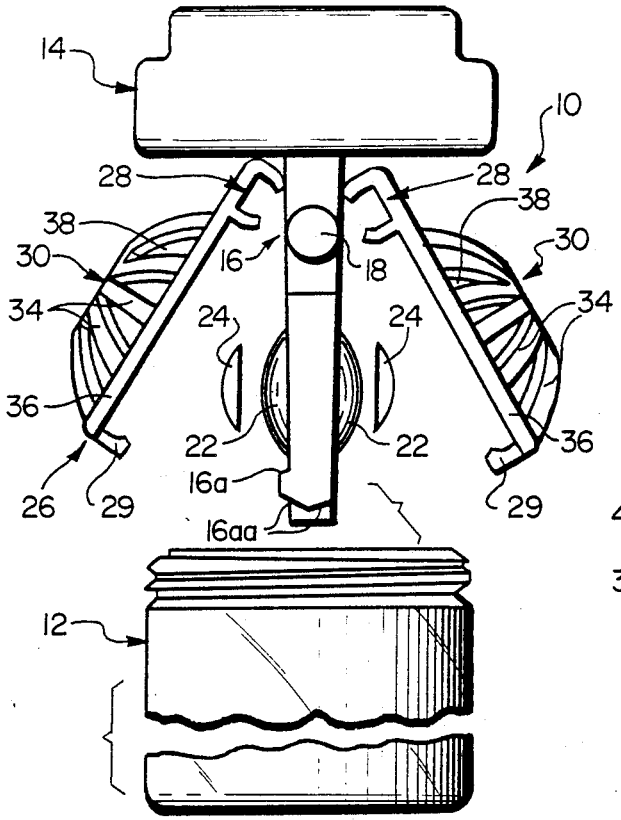
FIG. 1 is an exploded, partial elevational view of a container and contact lens support structure in one embodiment of the invention.

Referring in more detail to FIG. 1, a contact lens case is generally designated by reference character 10. The lens case 10 includes a container 12 with a generally cylindrical body having a threaded opening end for receiving the removable screw cap 14. The container 12 and screw cap 14 are each molded from simple plastic material. The cap 14 can have a venting conduit formed therein (not shown) for release of pressurized gas generated by a lens disinfection process carried out within the capped container, as more fully described in U.S. Pat. No. 4,637,919.

Depending from and integral with the cap 14 is a lens-supporting frame 16 which projects downwardly into the container 12 when the cap 14 is mounted thereon. A pair of opposed, axially aligned trunnions or pivot-bearing pins, one of which is shown at 18, are integrally molded adjacent the bottom end of a vertically-extending stem 20 on the frame 16. Integrally molded beneath the pins 18 is a bulbous or button-like structure having opposed, convex lens-receiving support services 22, 22 which extend from the lower frame portions **16*a*. The surface 22, 22 receive and generally conform to the concave surface portion of the respective contact lenses 24, 24**.

Figure 2:
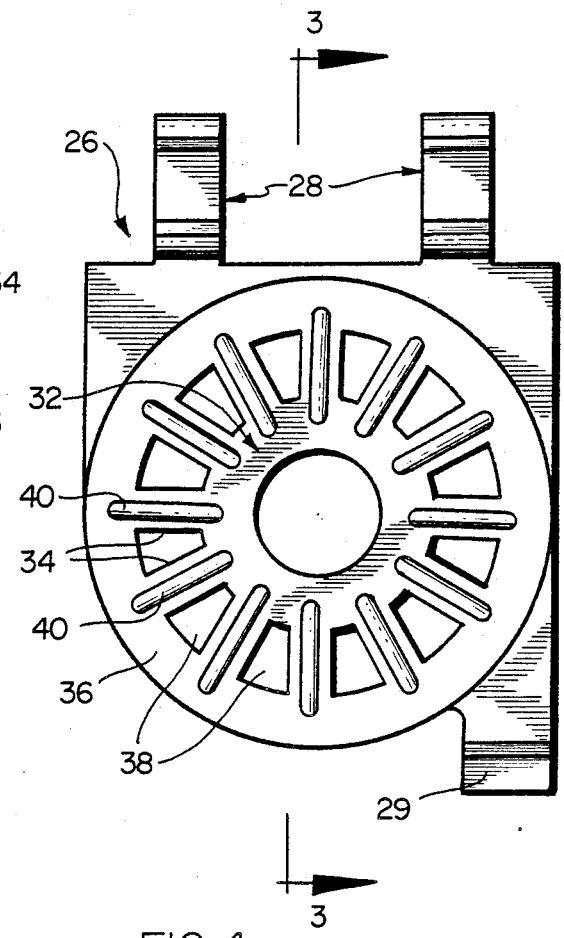
FIG. 2 is an enlarged, interior plan view of a lens holder and cover member shown in FIG. 1.

Pivotably mounted on the pins 18 are opposingly swinging lens holders or cover members generally designated by reference character 26, 26. At its upper end, each lens holder 26 has a pair of arm members 28, 28, as best shown in FIG. 2, which are pivotably supported on the bearing pins 18. The pivot arms 28 of each holder member 26 are snap-fit over the bearing pins 18 so that each holder member 26 pivotably swings independently. Each holder member 26 includes a basket-like lens cover 30 integrally molded below the pivot arms 20*a*. The interior side of each lens cover 30 has a concave configuration corresponding to the convex side of the respective contact lens 24.

Referring to the interior side of the lens cover 30 shown in FIG. 2, the lens cover 30 includes an aperture annulus 32 and a series of curved spoked members 34 radiating therefrom and joined to a surrounding rim or annulus 36, which spoke member 34 includes inner edges 35 and 37 that partially define the openings or slots 38 in said cover 30. When the pivotable holder member 26 is in a fully closed position in which the rim 36 engages the lower frame portion 16*a*, the lens cover 30 retains the lens 24 supported on the surface 22 while allowing passage of fluid through slots 38 between the spoke members 36 to immerse the lens 24 in the fluid within the container 12. The holder member 26 is retained in the closed position by a latch member 39 which releasably snaps into securement on the tapered bottom edge 16*aa* of the frame 16 as shown in FIG. 1.

Each of the spoke members 34 has a narrower and longitudinally aligned rib member 40 which extends from the inner surface of the spoke member 34 inwardly toward the frame 16. In the illustrated embodiment of the cover member 30, the rib members 40 are longer than the corresponding spoke member 34 so that the rib members partially project from both the annulus 32 and rim 36. The annular arrangement of the projecting rib members 40 provide an embossed or raised surface area for contact with the respective lens 24. Thus, the surface area available to support or contact the lens and to which the lens may adhere is significantly reduced in relation to the area of the spoke members 34 themselves so that the reduced contact surface of the ribs 40 promote the more desirable adherence of the lens 24 to the support surface 22. Furthermore, if the lens 24 does adhere to the reduced surface area of ribs 40, the lens is much more easily manually removed from the basket-like cover member 30 due to the reduced surface tension for adherence.

Figure 3:
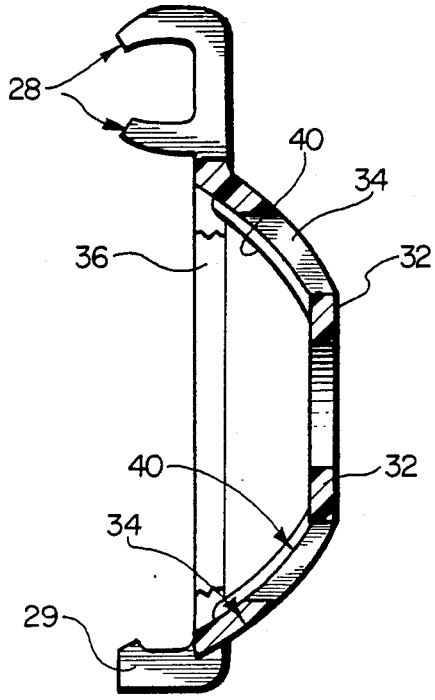
FIG. 3 is a sectional view taken along line 3—3 in FIG. 2 and viewed in the indicated direction.
Figure 4:
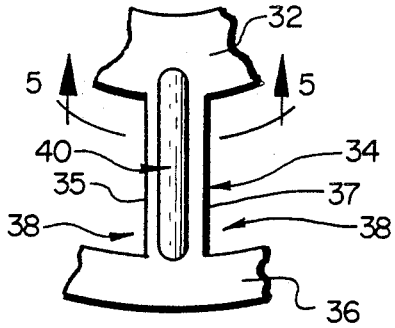
FIG. 4 is an enlarged, fragmentary view of a rib projection taken from the cover member shown in FIG. 2.
Figure 5:
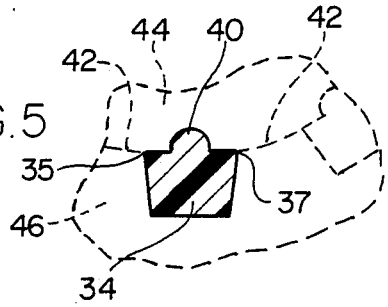
FIG. 5 is a sectional view taken along line 5—5 in FIG. 4 and further showing mold tooling in phantom view.

As a further significant feature, as shown in FIGS. 3 and 5, the embossed ribs 40 provide support surfaces for the lens which are remote or displaced from the edges 35; 37 of the spoke member 34 which define the openings or slots 38 in the basket or cover 30. As best seen in FIG. 5, the parting or flash line encountered during molding exist at these edges 35; 37. More specifically, when the cover 30 is molded, the mold halves 44 and 46 will meet along the edges 35; 37. Thus, any flash produced during molding will be confined to these edges. Accordingly, upon removal of a lens from the cover 30 the lens will slide over or along the rib member 40, without the damages or risk that the lens will contact any flash which may be present at the edges 35 or 37, or for that matter, without contacting the edges 35 or 37 which will be relatively sharp, even in the absence of flash.

Thus, not only does the structure of the present invention facilitate removal of a lens 24 adhered to the cover 30, but also reduces the risk of damage to said lens during such removal.

In light of foregoing description of the embodied lens holding and support structure, modifications will be evident to those skilled in design of such structures, and are within the broad scope of the appended claims.

The invention is claimed as follows:

1. A contact lens holder member for assembly in pivotal relation to a surface support means for a contact lens, said holder member comprising: a cover member for overlying said surface support means in a closed position for releasably enclosing said lens therebetween, said cover member including an interior surface for oppositely facing said surface support means in said closed position of said cover member, said cover member further including a plurality of through apertures opening through said interior surface for passage of lens conditioning fluid therethrough and defining a plurality of spaced spoke portions between said through apertures, wherein a plurality of said spoke portions include respective rib members extending therefrom toward said surface support means in said closed position, in order to provide that in the event said lens adheres to said cover member, said lens is supported or rests upon said protective rib members and is spaced from said spoke portions such that sliding movement of said lens during removal will be along said protective rib members without the lens engaging said spoke portions.

2. The contact lens holder member according to claim 1, wherein at least one of said protective rib members has an elongate configuration longitudinally aligned along said respective spoke member.

3. The contact lens holder member according to claim 2, wherein at least one of said protective rib members has a length greater than said respective spoke member.

* * * * *